US005484145A

United States Patent [19]

Shriver

[11] Patent Number: 5,484,145

[45] Date of Patent: Jan. 16, 1996

[54] PORTABLE PITCHING AID

[76] Inventor: James M. Shriver, 14550 Rosemary Dr., Fontana, Calif. 92335

[21] Appl. No.: 298,319

[22] Filed: Sep. 1, 1994

[51] Int. Cl.[6] ..... A63B 69/40

[52] U.S. Cl. ..... 273/26 A

[58] Field of Search ..... 273/26 A, 26 R, 273/29 A, 317, 407, 55 R

[56] References Cited

U.S. PATENT DOCUMENTS

| | | | |
|---|---|---|---|
| 1,592,005 | 7/1926 | Rovane | 273/26 A |
| 2,978,246 | 4/1961 | Gronningen | 273/26 A |
| 3,820,787 | 6/1974 | Heinbigner | 273/55 B |
| 4,092,023 | 5/1978 | Hazen | 273/26 A |
| 4,295,648 | 10/1981 | Stromback | 273/29 A |
| 4,502,685 | 3/1985 | Phillips | 273/29 A |
| 4,718,668 | 1/1988 | Schipske | 273/29 A |
| 5,029,853 | 7/1991 | Cunningham | 273/55 B |

*Primary Examiner*—Theatrice Brown

[57] ABSTRACT

A new and improved portable pitching aid with a hollow base portion having a support bar extending from one portion to an opposing portion. A hollow outer vertical support bar is integral with a midpoint of the support bar of the hollow base portion. A hollow inner vertical support bar is slidably received within the hollow outer vertical support bar. An adjustment means adjusts the height of the inner vertical support bar within the outer vertical support bar. An outer hollow U-shaped frame is integral with the hollow inner vertical support bar. An inner hollow inverted U-shaped frame is slidably received within the outer hollow U-shaped frame. An adjustment means adjusts the height of the inner hollow inverted U-shaped frame within the outer hollow U-shaped frame.

7 Claims, 4 Drawing Sheets

PORTABLE PITCHING AID

BACKGROUND OF THE INVENTION

1. Field of the Invention

The present invention relates to a portable pitching aid and more particularly pertains to outlining a strike zone with adjustment features to aid a pitcher in learning the art of pitching with a portable pitching aid.

2. Description of the Prior Art

The use of baseball targets is known in the prior art. More specifically, baseball targets heretofore devised and utilized for the purpose of providing a target for pitchers are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,497,485 to Macosko discloses a baseball pitching target.

U.S. Pat. No. 4,830,369 to Poitras discloses a baseball pitching practice target.

U.S. Pat. No. 4,295,648 to Stromback discloses a baseball pitchers target.

U.S. Pat. No. 4,210,326 to Booth et al. discloses a portable baseball pitching target and catching apparatus.

U.S. Pat. No. 5,064,194 to Bixler et al. discloses an apparatus for use in practicing pitching of baseballs.

While these devices fulfill their respective, particular objective and requirements, the aforementioned patents do not describe a portable pitching aid for outlining a strike zone with adjustment features to aid a pitcher in learning the art of pitching.

In this respect, the portable pitching aid according to the present invention substantially departs from the conventional concepts and designs of the prior art, and in doing so provides an apparatus primarily developed for the purpose of outlining a strike zone with adjustment features to aid a pitcher in learning the art of pitching.

Therefore, it can be appreciated that there exists a continuing need for new and improved portable pitching aid which can be used for outlining a strike zone with adjustment features to aid a pitcher in learning the art of pitching. In this regard, the present invention substantially fulfills this need.

SUMMARY OF THE INVENTION

In the view of the foregoing disadvantages inherent in the known types of baseball targets now present in the prior art, the present invention provides an improved portable pitching aid. As such, the general purpose of the present invention, which will be described subsequently in greater detail, is to provide a new and improved portable pitching aid and method which has all the advantages of the prior art and none of the disadvantages.

To attain this, the present invention essentially comprises a hollow base portion having an upper surface, a lower surface, an inner surface, and an outer surface, and four side portions. A support bar extends from the inner surface of one of the four side portions to the inner surface of an opposing side portion. The support bar has an upper surface and a lower surface. The device contains a hollow outer vertical support bar having a first end, an open second end, and an intermediate extent therebetween. The first end is integral with a midpoint of the upper surface of the support bar of the hollow base portion. The intermediate extent has a plurality of vertical apertures therein. The device contains a hollow inner vertical support bar having a first end, a second end, and an intermediate extent therebetween. The intermediate extent has a plurality of vertical apertures therein. A tension biased detent element is secured within the intermediate extent. The hollow inner vertical support bar is slidably received within the hollow outer vertical support bar. The plurality of vertical apertures of the intermediate extent align with the plurality of vertical apertures in the intermediate extent of the hollow outer vertical support bar. The tension biased detent element serves to adjustably couple the aligning apertures to adjust the height of the inner vertical support bar within the outer vertical support bar. The device contains an outer hollow U-shaped frame having a base portion and two arm portions. The base portion is integral with the first end of the hollow inner vertical support bar. The two arm portions have open end portions. The two arm portions have a plurality of vertical apertures therein. The device contains an inner hollow inverted U-shaped frame having a base portion and two arm portions. The two arm portions have a plurality of vertical apertures therein. A tension biased detent element is secured within each of the two arm portions. The two arm portions are slidably received within the two arm portions of the outer hollow U-shaped frame. The plurality of vertical apertures align with the plurality of vertical apertures of the outer hollow U-shaped frame. The tension biased detent element serves to adjustably couple the aligning apertures to adjust the height of the inner hollow inverted U-shaped frame within the outer hollow U-shaped frame. Lastly, the device contains a plurality of straps. Each of the straps has a first end, a second end, and an intermediate extent therebetween. The second end has a metal hoop thereattached. The first end is secured around one of the four side portions of the hollow base portion to the second end. Each metal hoop is secured to a portion of ground to hold the device in place.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable pitching aid which has all the advantages of the prior art baseball targets and none of the disadvantages.

It is another object of the present invention to provide a new and improved portable pitching aid which may be easily and efficiently manufactured and marketed.

It is a further object of the present invention to provide a new and improved portable pitching aid which is of durable and reliable construction.

An even further object of the present invention is to provide a new and improved portable pitching aid which is susceptible of a low cost of manufacture with regard to both materials and labor, and which accordingly is then susceptible of low prices of sale to the consuming public, thereby making such a portable pitching aid economically available to the buying public.

Still yet another object of the present invention is to provide a new and improved portable pitching aid which provides in the apparatuses and methods of the prior art some of the advantages thereof, while simultaneously overcoming some of the disadvantages normally associated therewith.

Even still another object of the present invention is to provide a new and improved portable pitching aid for outlining a strike zone with adjustment features to aid a pitcher in learning the art of pitching.

Lastly, it is an object of the present invention to provide a new and improved portable pitching aid with a hollow base portion having a support bar extending from one portion to an opposing portion. A hollow outer vertical support bar is integral with a midpoint of the support bar of the hollow base portion. A hollow inner vertical support bar is slidably received within the hollow outer vertical support bar. An adjustment means adjusts the height of the inner vertical support bar within the outer vertical support bar. An outer hollow U-shaped frame is integral with the hollow inner vertical support bar. An inner hollow inverted U-shaped frame is slidably received within the outer hollow U-shaped frame. An adjustment means adjusts the height of the inner hollow inverted U-shaped frame within the outer hollow U-shaped frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
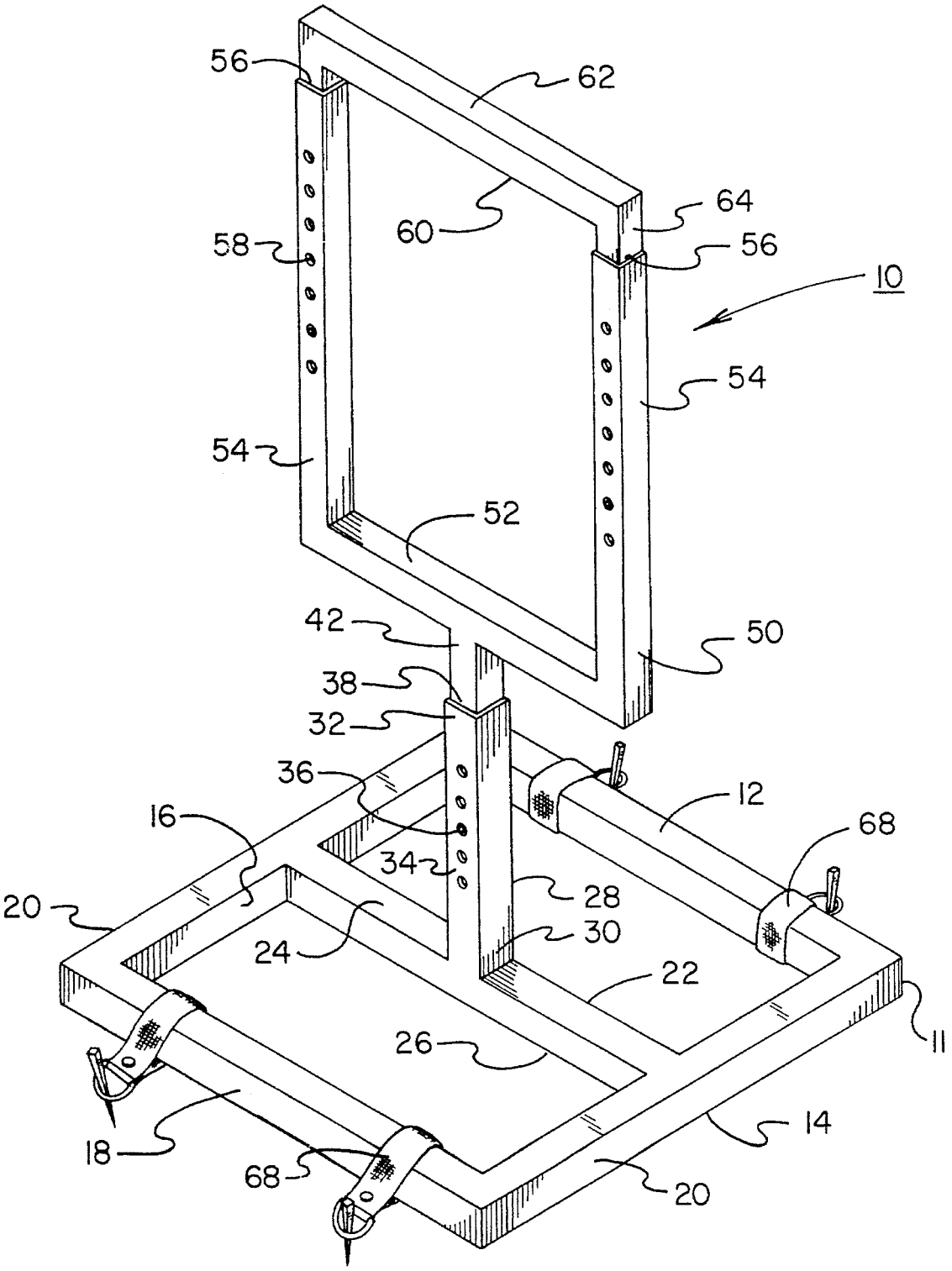
FIG. 1 is a perspective view of the preferred embodiment of the portable pitching aid constructed in accordance with the principles of the present invention.
Figure 2:
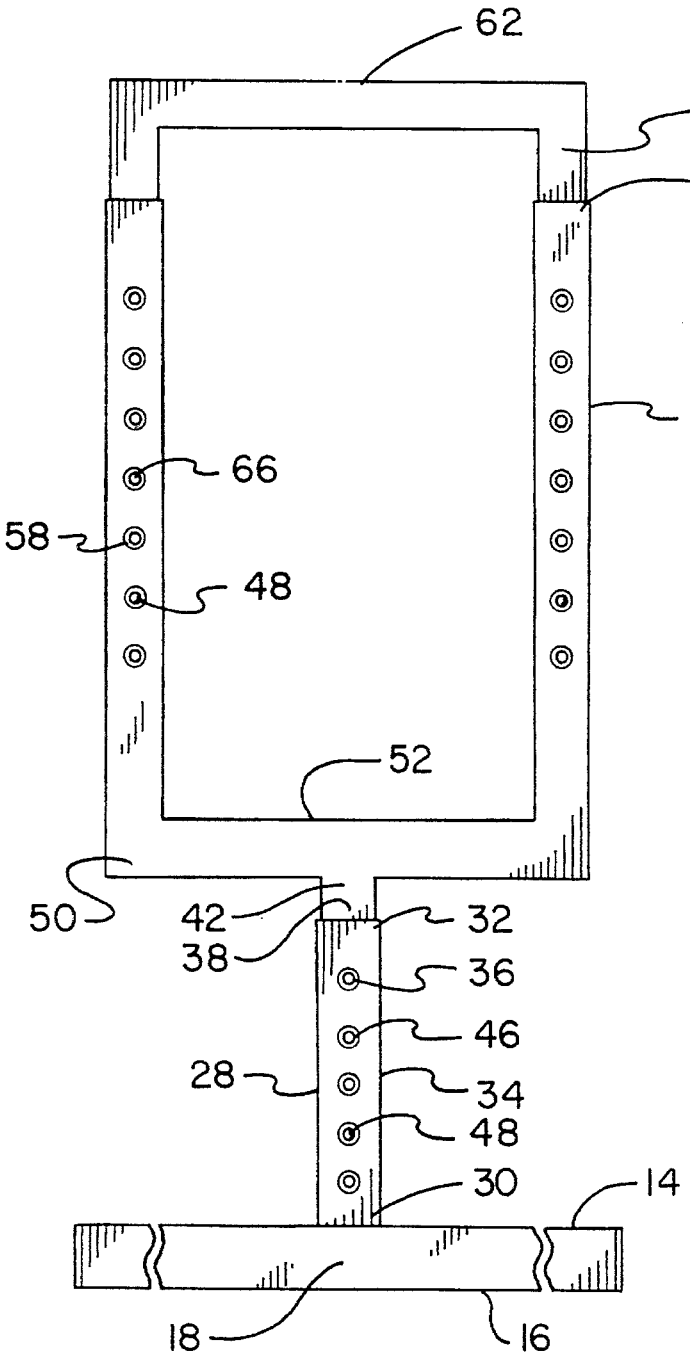
FIG. 2 is a front view of the preferred embodiment of the present invention.
Figure 3:
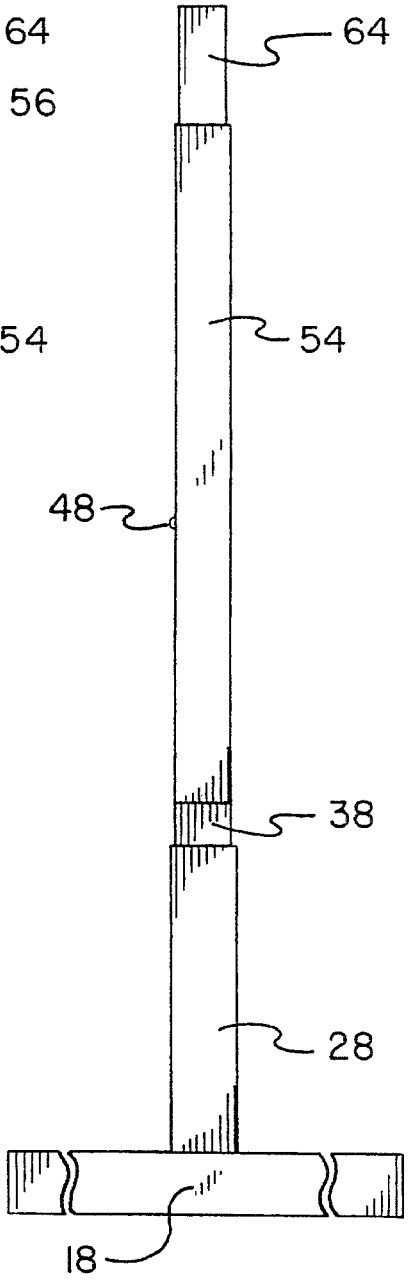
FIG. 3 is a side view of the preferred embodiment of the present invention.
Figure 4:
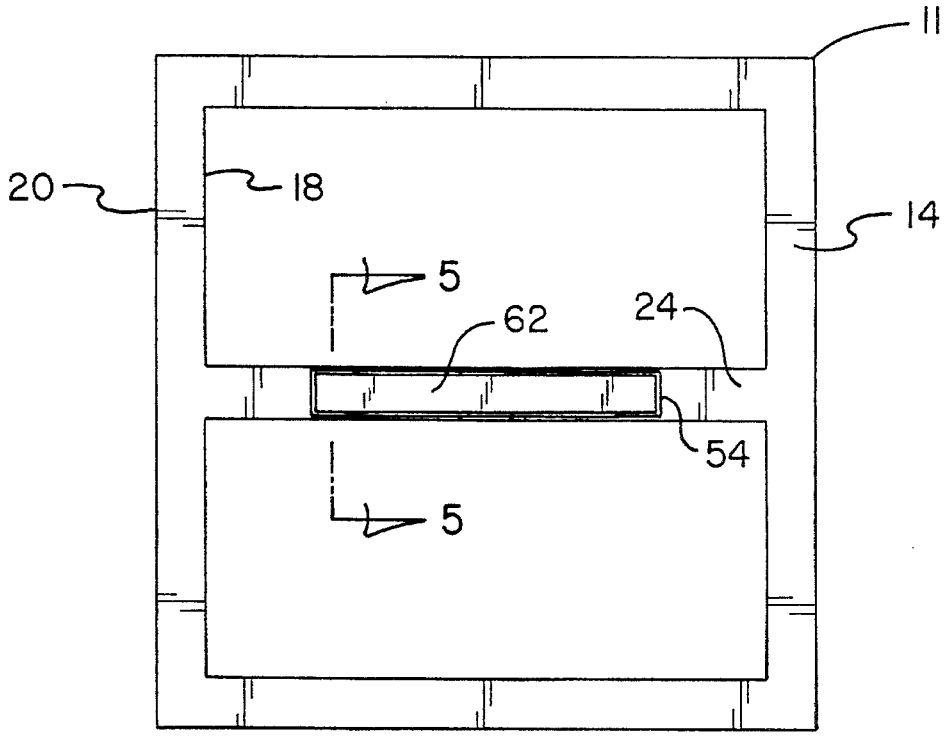
FIG. 4 is a plan view of the preferred embodiment of the present invention.
Figure 5:
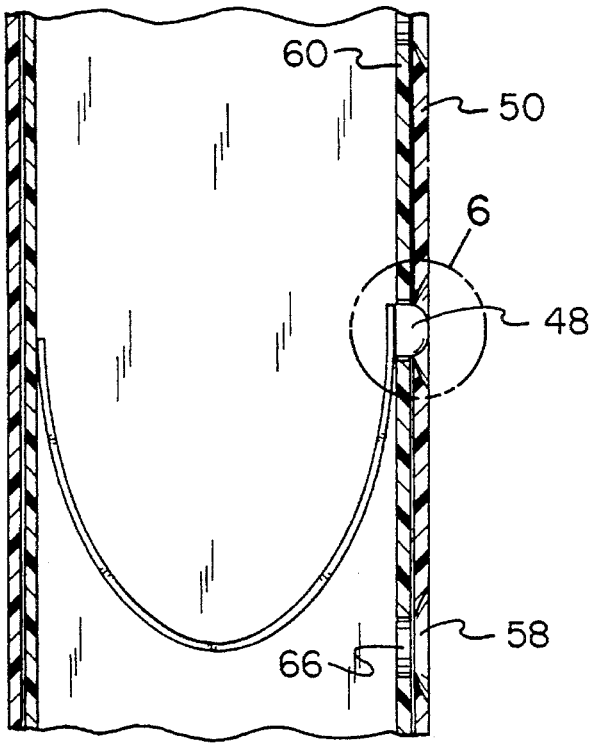
FIG. 5 is a cross-sectional view taken along line 5—5 of FIG. 4.
Figure 6:
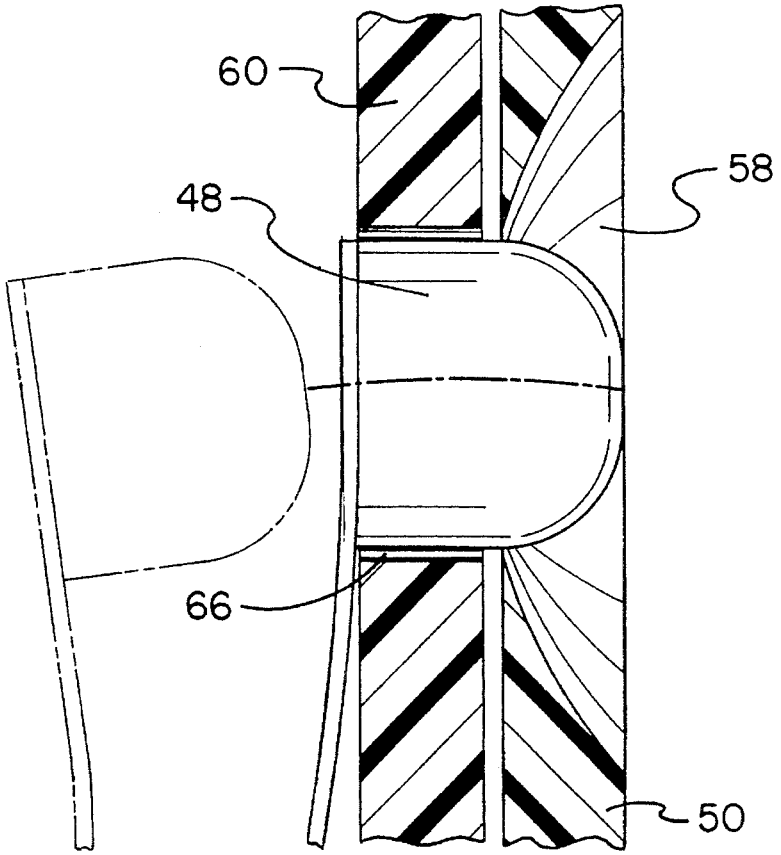
FIG. 6 is an enlarged sectional view of the tension biased detent element taken from FIG. 5.
Figure 7:
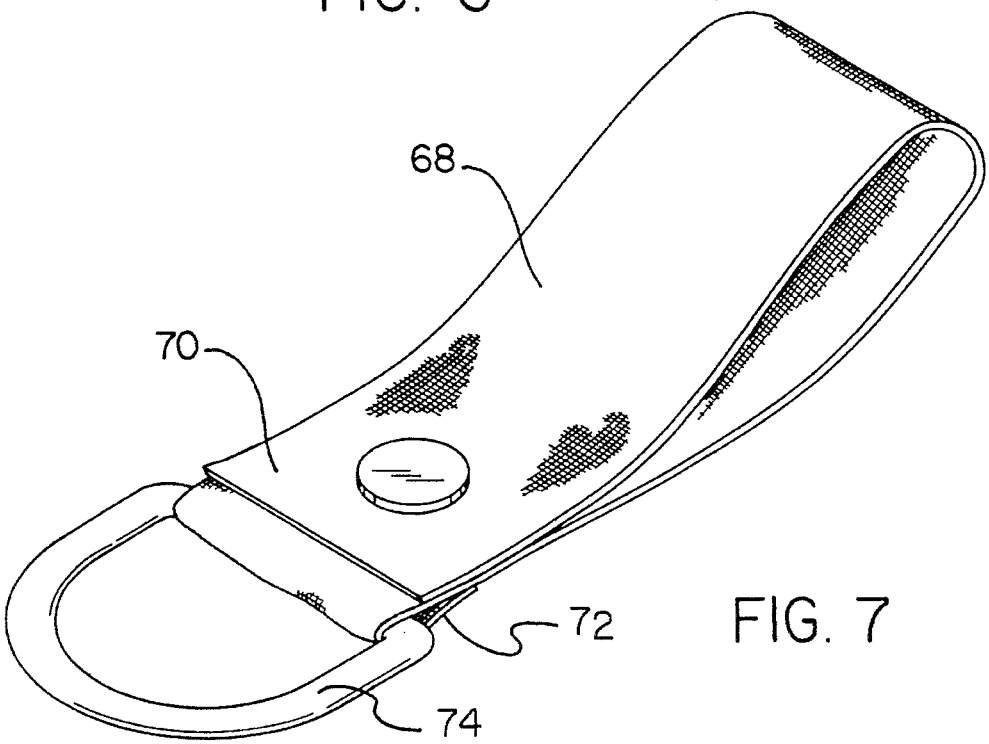
FIG. 7 is a perspective view of the straps of the present invention.

With reference now to the drawings, and in particular, to FIG. 1 thereof, the preferred embodiment of the new and improved portable pitching aid embodying the principles and concepts of the present invention and generally designated by the reference number 10 will be described.

Specifically, it will be noted in the various Figures that the device relates to a new and improved portable pitching aid for outlining a strike zone with adjustment features to aid a pitcher in learning the art of pitching. In its broadest context, the device consists of a hollow base portion, a hollow outer vertical support bar, a hollow inner vertical support bar, an outer hollow U-shaped frame, an inner hollow inverted U-shaped frame, and a plurality of straps.

The device 10 contains a hollow base portion 11 having an upper surface 12, a lower surface 14, an inner surface 16, and an outer surface 18, and four side portions 20. A support bar 22 extends from the inner surface 16 of one of the four side portions 20 to the inner surface 16 of an opposing side portion 20. The support bar 22 has an upper surface 24 and a lower surface 26. The hollow base portion 11 could optionally be constructed of a heavier material, such as wood or metal, to give the device 10 a sturdier base.

The device 10 contains a hollow outer vertical support bar 28 having a first end 30, an open second end 32, and an intermediate extent 34 therebetween. The first end 30 is integral with a midpoint of the upper surface 24 of the support bar 22 of the hollow base portion 11. The intermediate extent 34 has a plurality of vertical apertures 36 therein. The plurality of apertures 36 are preferably spaced 1½ inches apart. The aperture closest to the hollow base portion 11 would preferably be 13½ inches from the ground. The aperture furthest from the hollow base portion would preferably be 19½ inches from the ground.

The device 10 contains a hollow inner vertical support bar 38 having a first end 40, a second end 42, and an intermediate extent 44 therebetween. The intermediate extent 44 has a plurality of vertical apertures 46 therein. A tension biased detent element 48 is secured within the intermediate extent 44. The hollow inner vertical support bar 38 is slidably received within the hollow outer vertical support bar 28. The plurality of vertical apertures 46 of the intermediate extent 44 align with the plurality of vertical apertures 36 in the intermediate extent 34 of the hollow outer vertical support bar 28. The tension biased detent element 48 serves to adjustably couple the aligning apertures 36,46 to adjust the height of the inner vertical support bar 36 within the outer vertical support bar 28. This is accomplished simply by pressing the tension biased detent element 48 inward and then either raise or lower the inner vertical support bar 36 within the outer vertical support bar 28. The inner vertical support bar 36 and the outer vertical support bar 28 together form the knee height adjustment. Depending on the height of a simulated batter desired, the knee height adjustment can be adjusted to the point where the batter's knees would be, so as to create the low point for the strike zone that the user concentrates on hitting.

The device 10 contains an outer hollow U-shaped frame 50 having a base portion 52 and two arm portions 54. The base portion 52 is integral with the first end 38 of the hollow inner vertical support bar 36. The two arm portions 54 have open end portions 56. The two arm portions 54 have a plurality of vertical apertures 58 therein. The plurality of vertical apertures 58 are preferably spaced 2 inches apart. The aperture closest to the knee height adjustment would preferably be 27 inches from the ground. The aperture furthest from the knee height adjustment would be preferably 39 inches from the ground.

The device 10 contains an inner hollow inverted U-shaped frame 60 having a base portion 62 and two arm portions 64. The two arm portions 64 have a plurality of vertical apertures 66 therein. A tension biased detent element 48 is secured within each of the two arm portions 64. The two arm portions 64 are slidably received within the two arm portions 54 of the outer hollow U-shaped frame 50. The plurality of vertical apertures 66 align with the plurality of vertical apertures 58 of the outer hollow U-shaped frame 50. The tension biased detent element 48 serves to adjustably couple the aligning apertures 58,66 to adjust the height of the inner hollow inverted U-shaped frame 60 within the outer hollow U-shaped frame 50. This is accomplished simply by pressing the tension biased detent element 48 inward and then either raise or lower the inner hollow inverted U-shaped frame 60 within the outer hollow U-shaped frame 50. The inner hollow inverted U-shaped frame 60 and the outer hollow U-shaped frame 50 together form the armpit height adjustment. Depending on the height of a simulated batter desired, the armpit height adjustment can be adjusted to the point where the batter's armpits would be, so as to create the high point for the strike zone that the user concentrates on hitting.

Lastly, the device 10 contains a plurality of straps 68. Each of the straps has a first end 70, a second end 72, and an intermediate extent therebetween. The second end 72 has a metal hoop 74 thereattached. The first end 70 is secured around one of the four side portions 20 of the hollow base portion 12 to the second end 72. Each metal hoop 74 is secured to a portion of ground to hold the device 10 in place. The preferable number of straps would be four, so that at least one strap can secure the device to the ground at each off the four portions 20 of the hollow base portion 11. A plurality of small stakes can accompany the device 10 to help secure the metal hoops 74 to the ground to prevent the device from falling over when struck by baseballs and softballs.

The present invention is a portable fixture that supports an adjustable frame which outlines the strike zone for baseball and softball batters.

The frame is made of plastic and has a rectangular base, with straps to hold it in place. A post extends up to support a rectangular picture frame. The width of the frame is fixed, so the height can be adjusted from between 27" to 39". This is done by moving bolts or pins in a vertical array of holes along each side, spaced at 2" intervals. The post is also made in two sections, with a series of vertical holes, through which pins are inserted to establish the lower position of the frame which is usually 13½" to 20" above the ground.

The fixture is used for pitching practice. It is erected to take the place of a batter, so the pitcher can see exactly where the ball has been delivered. They can hone their control of the pitches, and adjust them to accommodate batters of every size. Guesswork is completely eliminated because either the ball passed through the framed strike zone or it did not.

Regardless of the skill level, every pitcher can use this very convenient and inexpensive device. Any time a pitcher wishes to sharpen his or her skills, this frame can be set up and the pitcher can practice without the need for another player.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A portable pitching aid for outlining a strike zone with adjustment features to aid a pitcher in learning the art of pitching comprising, in combination:

a hollow base portion having an upper surface, a lower surface, an inner surface, and an outer surface, and four side portions, a support bar extending from the inner surface of one of the four side portions to the inner surface of an opposing side portion, the support bar having an upper surface and a lower surface;

a hollow outer vertical support bar having a first end, an open second end, and an intermediate extent therebetween, the first end being integral with a midpoint of the upper surface of the support bar of the hollow base portion, the intermediate extent having a plurality of horizontally extending vertically spaced apertures therein;

a hollow inner vertical support bar having a first end, a second end, and an intermediate extent therebetween, the intermediate extent having a plurality of horizontally extending vertically spaced apertures therein, a tension biased detent element secured within the intermediate extent, the hollow inner vertical support bar slidably received within the hollow outer vertical support bar, the plurality of apertures of the intermediate extent being aligned with the plurality of apertures in the intermediate extent of the hollow outer vertical support bar, the tension biased detent element extending into selected aligned apertures to adjustably couple the aligning apertures to adjust the height of the inner vertical support bar within the outer vertical support bar;

an outer hollow U-shaped frame having a base portion and two arm portions, the base portion integral with the first end of the hollow inner vertical support bar, the two arm portions having open end portions, the two arm portions having a plurality of horizontally extending vertically spaced apertures therein;

an inner hollow inverted U-shaped frame having a base portion and two arm portions, the two arm portions having a plurality of horizontally extending vertically spaced apertures therein, said inner frame having a tension biased detent element secured within each of the two arm portions, the two arm portions slidably received within the two arm portions of the outer hollow U-shaped frame, the plurality of apertures of said inner frame aligning with the plurality of apertures of the outer hollow U-shaped frame, the tension biased detent element extending into a pair of aligned apertures to adjustably couple the aligning apertures to adjust the height of the inner hollow inverted U-shaped frame within the outer hollow U-shaped frame;

a plurality of straps, each of the straps having a first end, a second end, and an intermediate extent therebetween, the second end having a metal hoop thereattached, the first end secured around one of the four side portions of the hollow base portion to the second end, each metal hoop secured to a portion of ground to hold the device in place.

2. The device as described in claim 1 and further including wherein the plurality of horizontally extending vertically spaced apertures of the hollow outer vertical support bar and the plurality of horizontally extending vertically spaced apertures of the hollow inner vertical support bar are spaced 1½ inches apart.

3. The device as described in claim 1 and further including wherein the plurality of horizontally extending vertically spaced apertures of the outer hollow U-shaped frame and the plurality of horizontally extending vertically spaced apertures of the inner hollow inverted U-shaped frame are spaced 2 inches apart.

4. A new and improved portable pitching aid for outlining a strike zone with adjustment features to aid a pitcher in learning the art of pitching comprising, in combination:

a hollow base portion having a support bar extending from one portion to an opposing portion;

a hollow outer vertical support bar integral with a midpoint of the support bar of the hollow base portion;

a hollow inner vertical support bar slidably received within the hollow outer vertical support bar, an adjustment means for allowing adjustment of the height of the inner vertical support bar within the outer vertical support bar;

an outer hollow U-shaped frame integral with the hollow inner vertical support bar;

an inner hollow inverted U-shaped frame slidably received within the outer hollow U-shaped frame, an adjustment means for allowing adjustment of the height of the inner hollow inverted U-shaped frame within the outer hollow U-shaped frame.

5. The device as described in claim 4 and further including wherein the hollow outer vertical support bar, the hollow inner vertical support bar, the outer hollow U-shaped frame, and the inner hollow inverted U-shaped frame, each having a plurality of horizontally extending vertically spaced apertures therein.

6. The device as described in claim 5 and further including wherein the adjustment means is a tension biased detent element.

7. The device as described in claim 6 and further including wherein a plurality of straps, each of the straps having a first end, a second end, and an intermediate extent therebetween, the second end having a metal hoop thereattached, the first end secured around the hollow base portion to the second end, each metal hoop secured to a portion of ground to hold the device in place.

* * * * *